US011578451B2

(12) United States Patent
Sreevidhas et al.

(10) Patent No.: US 11,578,451 B2
(45) Date of Patent: Feb. 14, 2023

(54) WASHER APPLIANCE HAVING REMOVABLE AGITATOR POST WITH LOCKING FEATURES

(71) Applicant: Haier US Appliance Solutions, Inc., Wilmington, DE (US)

(72) Inventors: Jebasingh Sreevidhas, Louisville, KY (US); Ajay Kumar Kommagalla, Hyderabad (IN)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 64 days.

(21) Appl. No.: 17/354,534

(22) Filed: Jun. 22, 2021

(65) Prior Publication Data

US 2022/0403580 A1 Dec. 22, 2022

(51) Int. Cl.

| | |
|---|---|
| ***D06F 37/24*** | (2006.01) |
| ***D06F 37/12*** | (2006.01) |
| ***D06F 17/06*** | (2006.01) |
| ***D06F 13/00*** | (2006.01) |
| ***D06F 13/02*** | (2006.01) |
| ***D06F 17/10*** | (2006.01) |

(52) U.S. Cl.

CPC ..... *D06F 37/24* (2013.01); *D06F 13/00* (2013.01); *D06F 13/02* (2013.01); *D06F 17/06* (2013.01); *D06F 17/10* (2013.01); *D06F 37/12* (2013.01)

(58) Field of Classification Search

CPC ..... D06F 13/00; D06F 13/02; D06F 17/06; D06F 17/10; D06F 37/12; D06F 37/24

See application file for complete search history.

(56) References Cited

U.S. PATENT DOCUMENTS

| | | | | |
|---|---|---|---|---|
| 3,648,486 | A * | 3/1972 | Rosinski, Jr. | D06F 13/00 68/4 |
| 3,805,559 | A * | 4/1974 | Waugh | D06F 13/02 68/4 |
| 5,611,221 | A * | 3/1997 | Tremel | D06F 17/08 68/133 |
| 5,689,847 | A * | 11/1997 | Tremel | D06F 17/08 68/134 |
| 5,784,902 | A * | 7/1998 | Pinkowski | D06F 13/02 68/12.02 |
| 10,787,761 | B2 * | 9/2020 | Czarnecki | D06F 17/10 |
| 2004/0016267 | A1 * | 1/2004 | Clark | D06F 13/02 68/133 |
| 2019/0017208 | A1 * | 1/2019 | Marangoni | D06F 37/16 |
| 2019/0062978 | A1 * | 2/2019 | Czarnecki | D06F 34/28 |
| 2021/0062382 | A1 * | 3/2021 | Andrejczuk | D06F 17/10 |

FOREIGN PATENT DOCUMENTS

| | | | |
|---|---|---|---|
| BR | MU9002286 | U2 | 3/2013 |
| GB | 437635 | A | 11/1935 |

* cited by examiner

*Primary Examiner* — Joseph L. Perrin
(74) *Attorney, Agent, or Firm* — Dority & Manning, P.A.

(57) ABSTRACT

A washing appliance with an agitator post configured for removable positioning in a receptacle. An actuator is used to selectively control the position of a shaft to as to provide for releasably locking the agitator post into position. A detent is positioned at the receptacle and can be configured for removable receipt of the downward end of the shaft when the bottom end of the agitator post is positioned in the receptacle.

20 Claims, 9 Drawing Sheets

WASHER APPLIANCE HAVING REMOVABLE AGITATOR POST WITH LOCKING FEATURES

FIELD OF THE INVENTION

The subject matter of the present disclosure relates generally to a washer appliance having a removable agitator post.

BACKGROUND OF THE INVENTION

Washing appliances (also referred to as "washing machines") typically include a drum or basket for receipt of articles to be washed. Top-load or vertical axis washing machines rotate the drum about the vertical axis at various points during the cleaning cycle. Various components provide for adding fluid into the drum and for imparting motion to the fluid and articles being washed in order to clean the articles.

Conventionally, the washing appliance may include a knob or other switch by which the user selects the level of fluid in the vertical axis washing machine based on e.g., the load size of articles being washed. The user visually determines the desired fluid level based on the anticipated load size. Many washing appliance users are also accustomed to seeing a conventional agitator in the form of a post extending up from the bottom of the wash basket and configured to impart motion to the fluid and articles during the cleaning cycles. Users may associate factors such as fluid level and movement of the agitator as directly related to the effective cleaning of the articles and may believe that increased fluids levels and agitator action are advantageous.

Certain articles may require more wash space within the wash drum. For example, large garments, pillows, comforters and the like may require more volume for washing than typical articles of clothing. Sufficient space is required in order for the washing appliance to be able to impart motion to the articles and wash fluid as part of the cleaning process. Conventional agitator designs having a post that extends into the wash basket necessarily consume at least part of this space. In addition, in such designs the agitator is typically not designed for removal by the user of the appliance.

Improvements in technology and increasing water conservation requirements have resulted in washing appliances that can use less water during the cleaning cycle and may use features other than the conventional post-type agitator for imparting the desired movement of the articles within the wash basket or wash drum. For example, rotatable impellers have been developed that can impart the desired movement while consuming less volume inside the wash drum than the conventional agitator. Some washing appliances utilizing such designs may also be able to use less water during the cleaning cycle as well.

However, user perception of washing machine features that provide for the best cleaning experience may contradict the actual impact of such features. As previously mentioned, consumers familiar with a conventional post-type agitator extending vertically from the bottom of the wash drum may be reluctant to purchase or use a vertical-axis washing appliance lacking such feature. Yet, depending on the particular design employed, an impeller located at the bottom of the wash drum may have more impact in creating the desired agitation and cleaning of articles than the conventional agitator—including under conditions of less water usage.

And for larger loads or loads with larger articles, the space consumed by the conventional post-type agitator is needed for the articles.

Accordingly, a washing appliance with a removable agitator would be useful. More particularly, a washing appliance that allows the user to readily install or remove an agitator while still providing for effective cleaning of articles would be beneficial. Such as washing appliance that can allow of the installation or removal without requiring special tools would be particularly beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides a washing appliance including a cabinet and a wash tub positioned in the cabinet, the wash tub defining a wash chamber. A wash drum is rotatably mounted within the wash chamber and configured for receiving articles for washing. An impeller is positioned in the wash drum, the impeller being rotational about a vertical axis and configured for imparting motion to the articles during washing. The impeller may define or support a receptacle. An agitator post can be configured for removable positioning in the receptacle of the impeller, the agitator post having a top end and a bottom end. The agitator post may define an interior.

A shaft can be positioned in the interior of the agitator post. The shaft may be movable along a vertical direction between an up position and a down position. The shaft can have an upward end and a downward end. A detent can be positioned at the receptacle. The detent can be configured for removable receipt of the downward end of the shaft when the bottom end of the agitator post is positioned in the receptacle. An actuator may be positioned near the top end of the agitator post and in mechanical communication with the shaft. The actuator is configured for selectively moving the shaft between the up position and the down position.

In another exemplary embodiment, a washing appliance includes a wash tub positioned in a wash chamber. A wash drum is rotatably mounted within the wash chamber and is configured for receiving articles for washing. An impeller is positioned in the wash drum. The impeller is rotational about a vertical axis and configured for imparting motion to the articles during washing. A receptacle may be supported by the impeller. An agitator post is include having a top end and a bottom end, the bottom end configured for removable receipt in the receptacle.

A shaft may be carried by agitator post. The shaft may be movable between an up position and a down position, the shaft having an upward end and a downward end. A detent can be positioned at the receptacle and below the downward end of the shaft when the agitator post is positioned into the receptacle. An actuator may be supported on the agitator post and can be connected with the shaft. The actuator may be configured for movement relative to the agitator post so as to selectively move the shaft between the up position and the down position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numbers in the figures denotes same or similar features unless the context indicates otherwise.

DETAILED DESCRIPTION OF THE INVENTION

Figure 1:
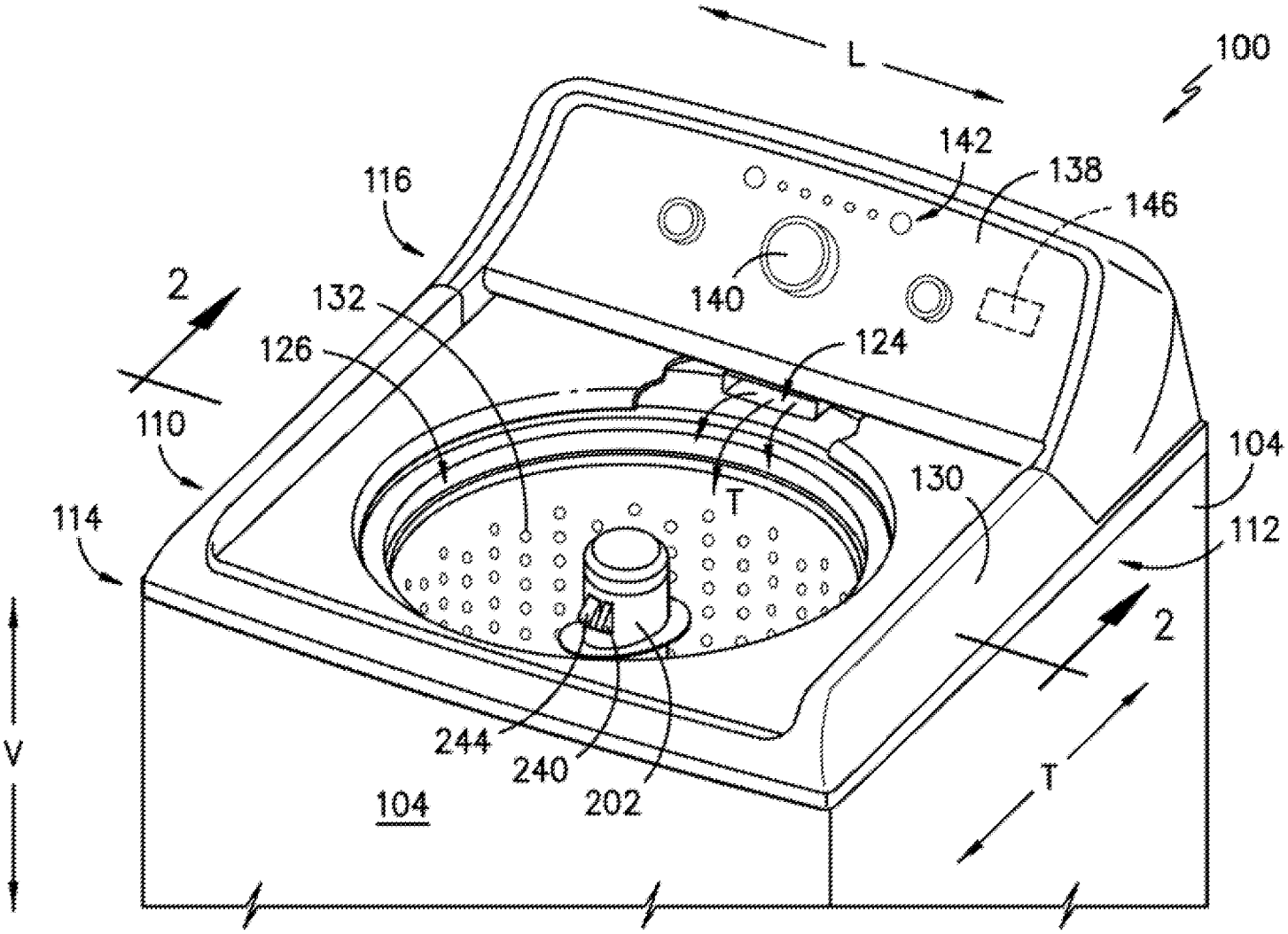
FIG. 1 provides a partial perspective view of an exemplary embodiment of a washing machine of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Figure 2:
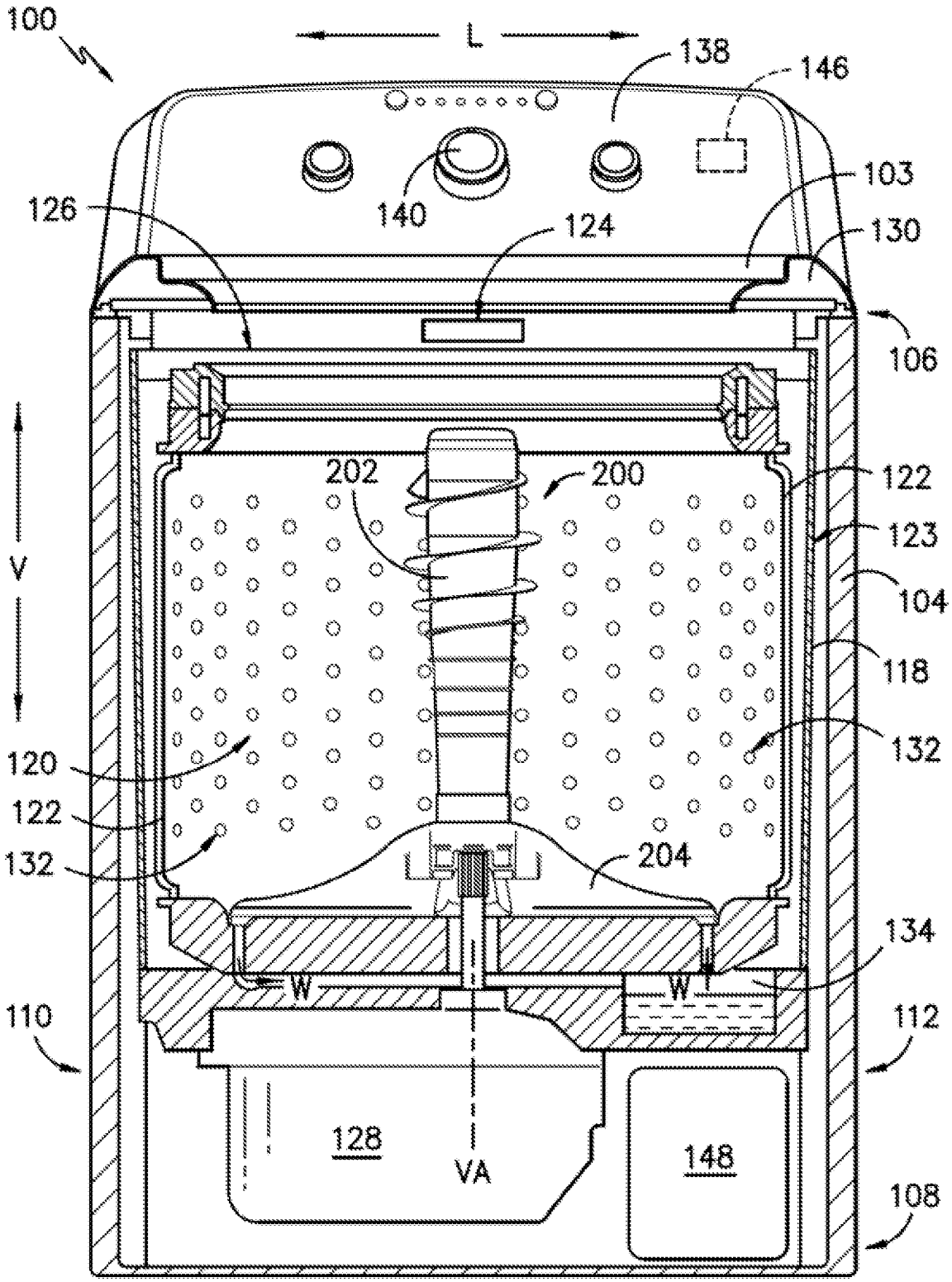
FIG. 2 provides a front cross-sectional view of the exemplary washing machine of FIG. 1.

FIGS. 1 and 2 illustrate an exemplary embodiment of a vertical axis washing appliance 100 of the present invention, which is also sometimes referred to as a top loading or vertical axis washing machine. The present invention is not limited to the particular vertical axis washing appliance 100 shown in the figures. Using the teachings disclosed herein, one or skill in the art will understand the other embodiments of a washing machine are also in the scope of the present invention.

In FIG. 1, a door 103 (shown in FIG. 2) has been removed for purposes of illustrating other features of the invention. Washing machine appliance 100 has a cabinet 104 that extends between a top portion 106 and a bottom portion 108 along the vertical direction V, between a first side (left) 110 and a second side (right) 112 along the lateral direction L, and between a front 114 and a rear 116 along the transverse direction T. Cabinet 104 is generally configured for containing and/or supporting various components of appliance 100 and may also define one or more internal chambers or compartments of appliance 100. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As best shown in FIG. 2, a wash tub 118 is positioned within cabinet 102, defines a wash chamber 120, and is generally configured for retaining wash fluids during an operating cycle. A wash drum 122 is rotatably mounted within wash chamber 120 of wash tub 118. Washing machine appliance 100 further includes a dispenser 124 for dispensing wash fluid into wash tub 118. In addition, appliance 100 may include one or more additional dispensers for directing fluid into wash tub 118 and each dispenser may be separately controlled by one or more valves controlling flow to each dispenser independently of the others. The term "wash fluid" refers to a liquid used for washing and/or rinsing articles during an operating cycle and may include any combination of water, detergent, fabric softener, bleach, and other wash additives or treatments. As used herein, the term "cleaning cycle" includes a wash cycle, rinse cycle, spin cycle, or combinations thereof.

Wash drum 122 and cabinet 104 generally define an opening 126 (accessible through door 103) for receipt of articles for washing. Wash drum 122 rotates about a vertical axis of rotation VA (FIGS. 2, 3, and 4) powered by motor assembly 128. According to the illustrated embodiment, the axis of rotation VA is substantially parallel to the vertical direction V.

As illustrated, cabinet 104 of washing machine appliance 100 has a top panel 130. Top panel 130 defines an opening (FIG. 1) that coincides with opening 126 of wash tub 118 to permit a user access to wash drum 122. Door 103 is rotatably mounted to top panel 130 to permit selective access to opening 126. In particular, door 103 selectively rotates between a closed position and an open position. In the closed position, door 103 inhibits access to wash drum 122. Conversely, in the open position, a user can access wash drum 122. Although door 103 is illustrated as mounted to top panel 130, door 103 may alternatively be mounted to cabinet 104 or any other suitable support.

As best shown in FIG. 2, wash drum 122 further defines a plurality of perforations 132 to facilitate fluid communication between an interior of wash drum 122 and wash tub 118. In this regard, wash drum 122 is spaced apart from wash tub 118 to define a space for wash fluid to escape wash chamber 120. During a spin cycle, wash fluid within articles being washed (e.g., clothing) and within wash chamber 120 is urged through perforations 132 wherein it may collect in a sump 134 defined by wash tub 118. Washing machine appliance 100 further includes a pump assembly 148 (FIG. 2) that is located beneath wash tub 118 and wash drum 122 for gravity assisted flow when draining wash tub 118.

An exemplary article movement mechanism 200, including impeller 204 (FIGS. 2 and 3) and agitator post 202, is rotatably mounted within wash drum 122 to impart motion to articles and liquid in wash drum 122. More specifically, impeller 204 and agitator post 202 extend into wash drum 122 and assist agitation of articles disposed within wash drum 122 (as will be later described) during operation of washing appliance 100, e.g., to facilitate improved cleaning. For this exemplary embodiment, agitator post 202 includes a helical vane 210 extending from the outer surface 212 of agitator post 202 between bottom end 216 and top end 214 thereof. Helical vane 210 may be configured to assist the agitation of articles or support the overall desired motion thereof during a cleaning cycle. As will be understood by one of skill in the art using teachings disclosed herein, helical vane 210 may have different shapes, thickness, and other features from what is depicted in the figures and may actually include multiples sets of overlapping or non-overlapping vanes.

In different embodiments, impeller 204 and agitator post 202 may rotate separately or together. Such rotations include a single action element (i.e., oscillatory only), a double action element (oscillatory movement at one end, single direction rotation at the other end) or a triple action element (oscillatory movement plus single direction rotation at one end, single direction rotation at the other end). Impeller 204, agitator post 202, and wash drum 122 are oriented to rotate about a vertical axis of rotation VA (which is substantially parallel to vertical direction V). For example, impeller 204 and/or agitator post 202 may rotate back and forth in alternate directions about vertical axis VA during a cleaning cycle. Additional description of the actions of impeller 204 and agitator post 202 are set forth below.

As stated, washing machine appliance 100 includes a motor assembly 128 in mechanical communication with wash drum 122 to selectively rotate wash drum 122 (e.g., during a wash cycle or a rinse cycle of washing machine appliance 100). In addition, motor assembly 128 may also be in mechanical communication with impeller 204 and agitator post 202. For this embodiment, impeller 204 is secured to a shaft 205 from motor assembly 128. In this manner, motor assembly 128 may be configured for selectively and independently rotating or oscillating wash drum 122, impeller 204, and/or agitator post 202 during various operating cycles of washing machine appliance 100.

Figure 3:
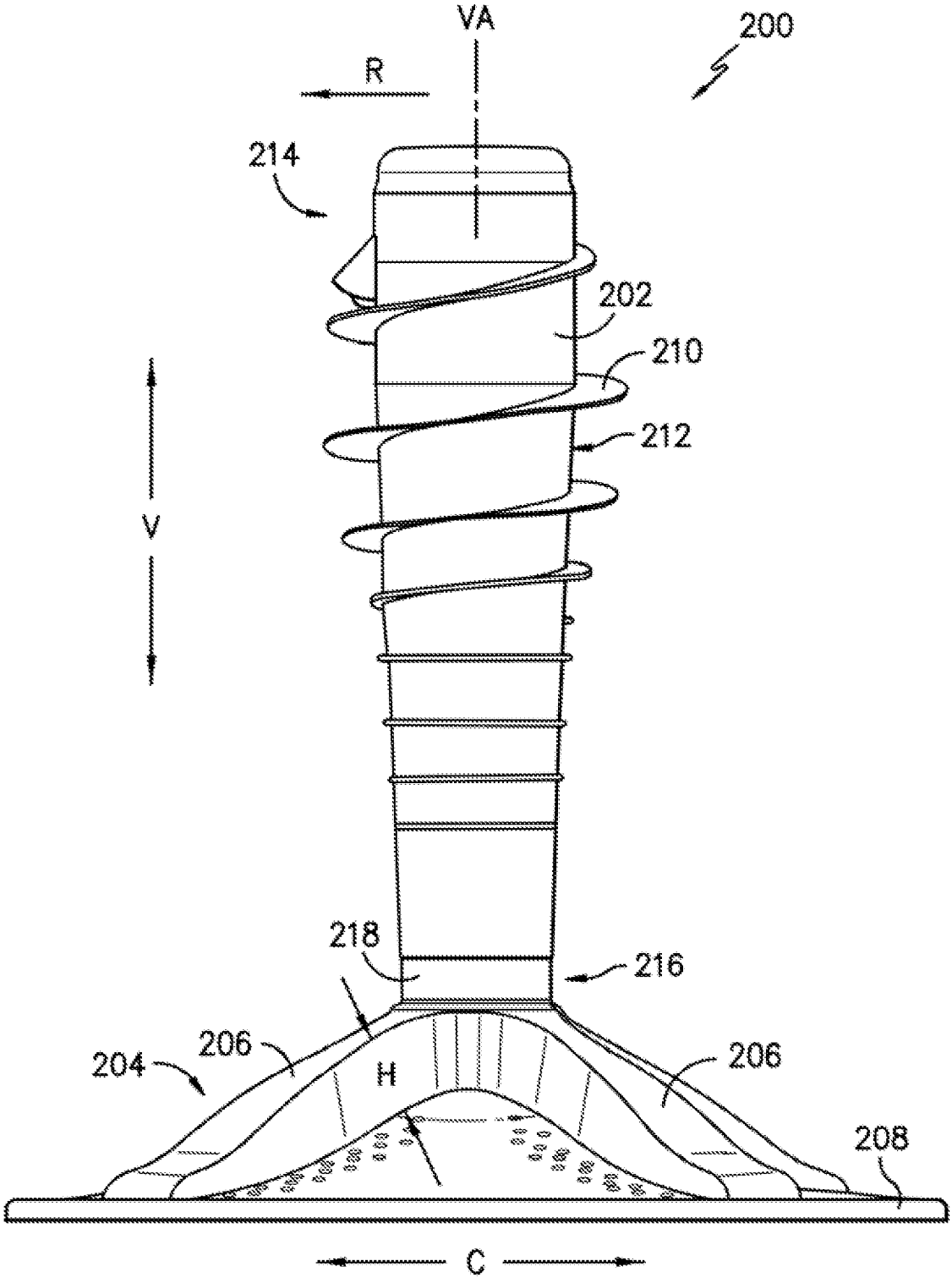
FIG. 3 provides an elevation view of an exemplary embodiment of an article movement mechanism of the present invention in which an exemplary agitator post and impeller are included.

Referring still to FIGS. 1 through 3, a control panel 138 with at least one input selector 140 (FIGS. 1 and 2) extends from top panel 130. Control panel 138 and input selector 140 collectively form a user interface input for operator selection of machine cycles and features of washing appliance 100. A display 142 of control panel 138 indicates selected features, operation mode, a countdown timer, and/or other items of interest to appliance users regarding operation.

Operation of washing machine appliance 100 is controlled by at least one controller or processing device 146 that is operatively coupled to control panel 138 for user manipulation to select washing machine cycles and features. In response to user manipulation of control panel 138, controller 146 operates the various components of washing machine appliance 100 to execute selected machine cycles and features. According to an exemplary embodiment, controller 146 may include a memory and microprocessor, such as a general or special purpose microprocessor operable to execute programming instructions or micro-control code associated with methods described herein. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 138 and other components of washing machine appliance 100 may be in communication with controller 146 via one or more signal lines or shared communication busses.

During operation of washing machine appliance 100, laundry items are loaded into wash drum 122 through opening 126, and washing operation is initiated through operator manipulation of input selector 140. Water, detergent and/or other fluid additives can be added to wash tub 118 and wash drum 122 through dispenser 124 and/or other dispensers as well. Controller 146 can operate one or more valves of washing appliance 100 to provide for filling wash tub 118 and wash drum 122 to the appropriate level for the amount of articles being washed and/or rinsed. By way of example for a wash mode, once wash drum 122 is properly filled with fluid, the contents of wash drum 122 can be agitated (e.g., with article movement mechanism 200 as discussed previously) for washing of laundry items in wash drum 122. The specific operation of wash appliance 100 by controller 146 will depend on various inputs including the cycle and other settings that may be selected by the user, the amount of article placed in wash chamber 120, and other variables as will be understood by one of skill in the art using the teachings disclosed herein.

By way of continuing example, after wash tub 118 is filled and the agitation phase of the wash cycle is completed, wash tub 118 and drum 122 can be drained, e.g., by drain pump assembly 148. Laundry articles can then be rinsed by again adding fluid to wash drum 122 and tub 118 again depending on the specifics of the cleaning cycle selected by a user. The impeller 204 and/or agitator post 202 may also provide agitation within wash drum 122. One or more spin cycles may also be used as part of the cleaning process. In particular, a spin cycle may be applied after the wash cycle and/or after the rinse cycle in order to wring wash fluid from the articles being washed. During a spin cycle, wash drum 122 is rotated at relatively high speeds to help wring fluid from the laundry articles through perforations 132. After articles disposed in wash drum 122 are cleaned and/or washed, the user can remove the articles from wash drum 122, e.g., by reaching into wash drum 122 through opening 126.

As will now be further described, the exemplary article movement mechanism 200 allows desired movements to be imparted to articles in wash drum 122 during a cleaning cycle. These movements, which can include combinations of movement along vertical direction V and radial direction R, assist in cleaning articles while in the wash fluid. One exemplary pattern of movement will now be described. Using the teachings disclosed herein, one of skill in the art will understand that other patterns or paths of fluid and/or article movement in drum 122 may be used as well in other embodiments of the invention.

For example, after articles to be cleaned and fluid are loaded into cylindrical wash drum 122, rotations of impeller 204 may impart an inverse toroidal motion to articles in wash drum 122 during a cleaning cycle. In such motion, articles may move vertically upward from impeller 204 along agitator post 202 and then radially outward (the radial direction is indicated by arrow R in FIG. 3, which is a direction perpendicular to vertical axis VA) at the top of an article load towards the cylindrical portion 123 of wash drum 122.

The articles then move vertically downward towards impeller 204 and radially inward along the bottom of an article load towards agitator post 202 where the cycle repeats under the influence of components such as impeller 204. Accordingly, during a cleaning cycle, this inverse toroidal motion results generally in a turnover of articles in wash drum 122. As used herein, "inverse toroidal motion" or "inverse toroidal movement" does not refer to the specific movement necessarily of any individual article but to the overall movement of articles in wash drum 122 instead. A variety of factors create the inverse toroidal motion the occurs in wash drum 122 including, for example, the relative amounts of fluid and articles present in drum 122, the shape of wash drum 122, the configuration and movements of agitator post 202, the configuration and movements of impeller 204, and other factors as well.

Figure 4:
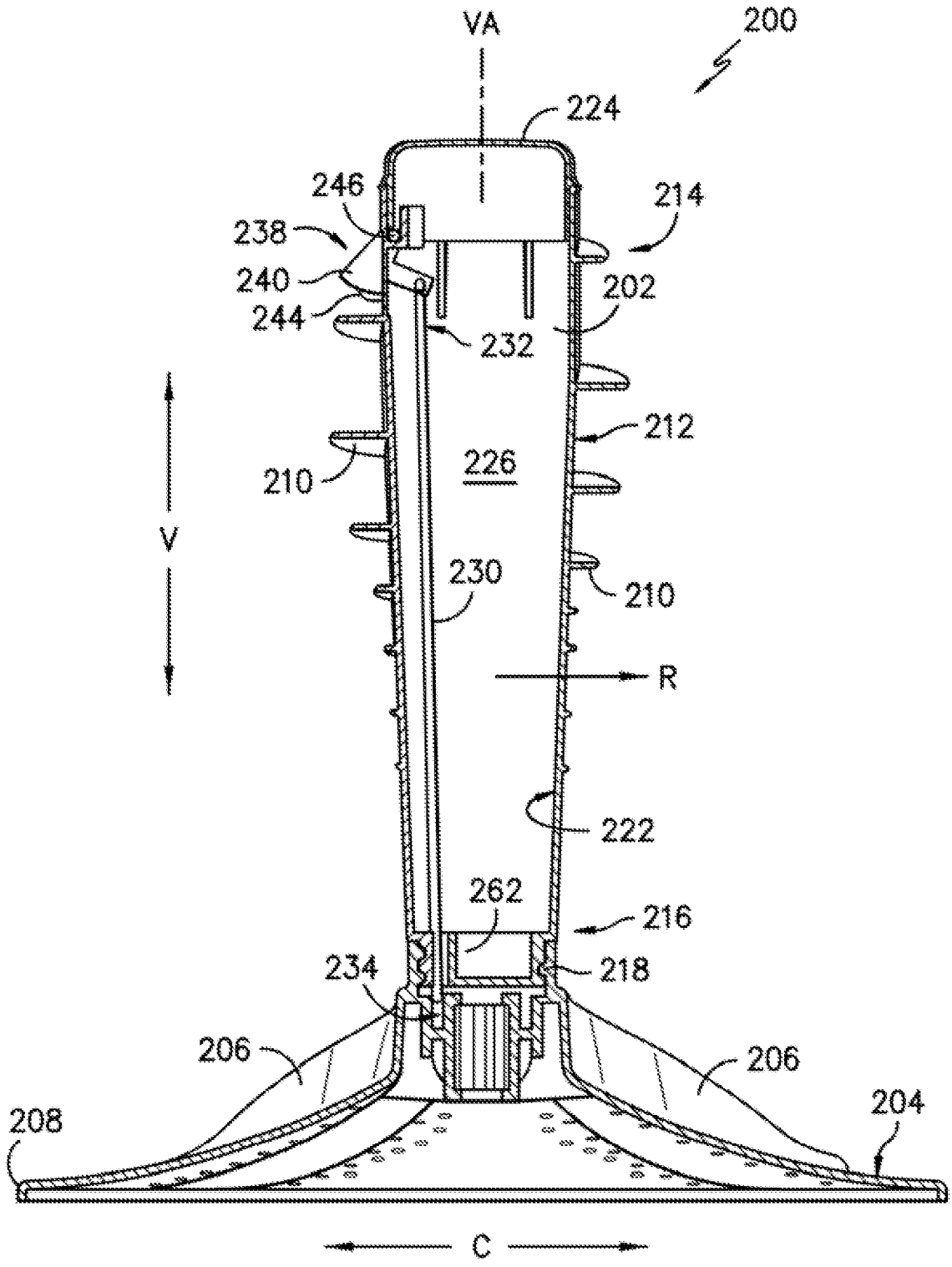
FIG. 4 provides a cross-sectional view of the exemplary article movement mechanism of FIG. 3.
Figure 5:
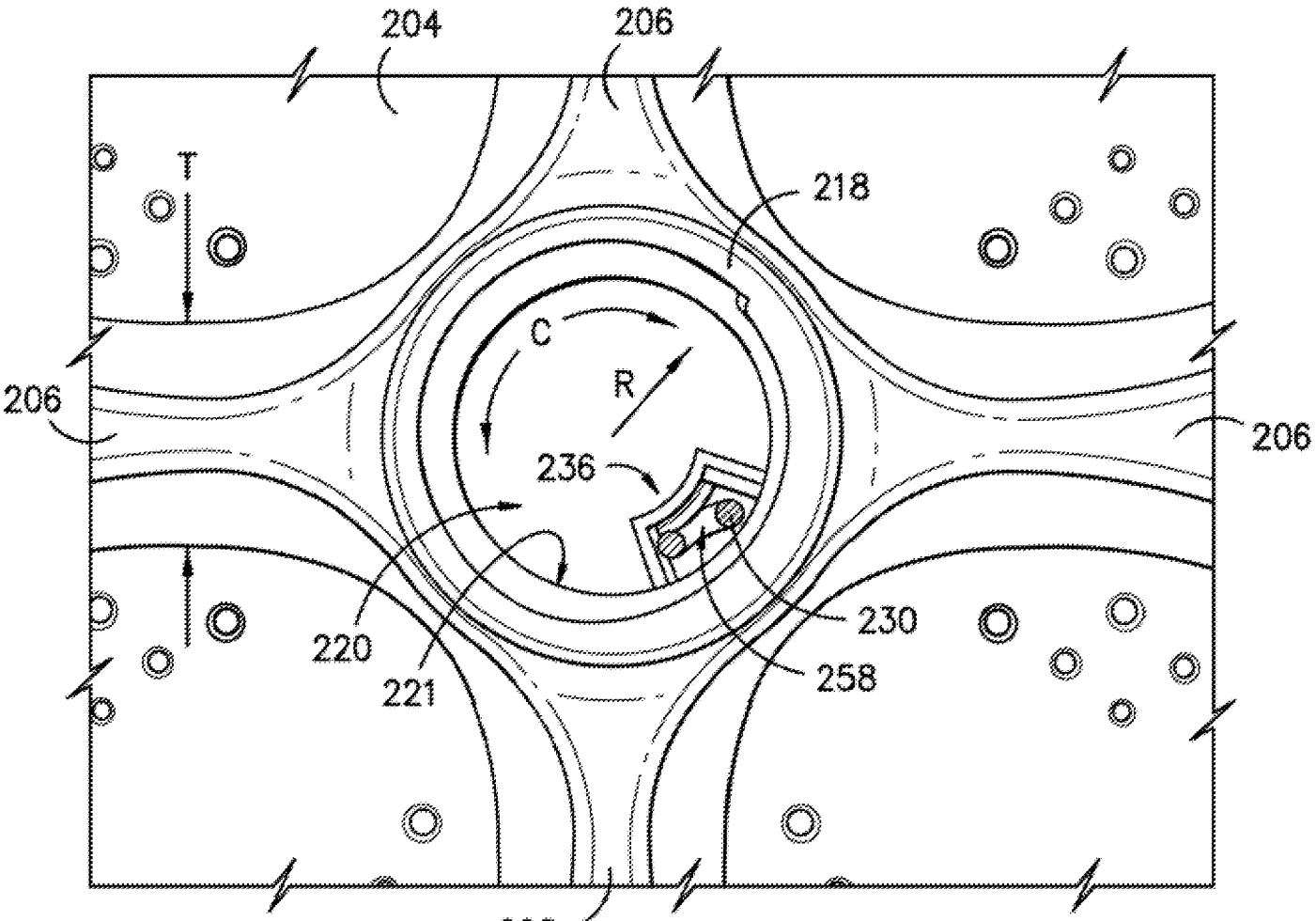
FIG. 5 is a top view of a portion of the exemplary article movement mechanism of FIGS. 3 and 4—including an exemplary receptacle.

With reference to FIGS. 3, 4, and 5, for this exemplary embodiment of mechanism 202, impeller 204 includes a plurality of radial lobes 206 spaced apart along circumferential direction C. Each lobe 206 has thickness T as measured along the circumferential direction C that varies moving along radial direction R. For the exemplary embodiment shown, thickness T narrows and then widens moving along radial direction R and away from agitator post 202. Each lobe 206 also has a height H above impeller base 208 along axial direction A that also varies along radial direction R. For the exemplary embodiment shown, height H gradually decreases moving along radial direction R and away from agitator post 202. Impeller 204 as depicted in FIGS. 3, 4, and 5 is provided by way of example only. Other shapes and configurations may be used as well.

As noted, the configuration of impeller 204 assists in creating the desired movement of fluid and/or articles within wash drum 122. Article movement mechanism 200 also includes an agitator post 202 which may assist in providing or supporting the desired movement. In addition, using features as will also be described, agitator post 202 can be readily installed or removed by a user of appliance 100 without the use of special tools. Removal of agitator post 202 allows more volume within wash drum 122 for the receipt of articles and/or fluid. At the same time, agitator post 202 can be readily installed as may be needed for a particular movement of articles in drum 122 or as may be based on e.g., user preference. An exemplary embodiment of agitator post 202 is set forth in the figures and will now be further described.

For this exemplary embodiment, bottom end 216 of agitator post 202 is removably received in a recess 220 defined by a receptacle 218. Receptacle 218 may be formed as an integral portion of impeller 204 or may be a separate component connected therewith. Bottom end 216 of agitator post 202 and interior surface 221 (FIG. 5) of receptacle 218 define complementary threads 254, 256 to releasably secure agitator post 202 within receptacle 218. Specifically, once bottom end 216 is inserted into receptacle 218, agitator post 202 can be rotated to engage threads 254 and 256 and position agitator post 202 for selectively locking its position using certain locking features as will be further described. Threads 254 and 256 can be disengaged by counter-rotation once the locking features have been released. In addition to complementary threads, other means for securing the position of agitator post 202 into receptacle 218 may be used as well.

As stated, article movement mechanism 200 includes locking features for releasably fixing the position of agitator post 202 in receptacle 218 until e.g., a user elects to remove it. Along with threads 254 and 256, one or more of such locking features also help transfer torque by securing the position of agitator post 202 relative to impeller 204 during operation of appliance 200. As determined by the user, appliance 200 can be operated without agitator post 202 as well.

More specifically, as shown in FIG. 4, agitator post 202 includes a shaft 230 positioned within interior 226. Shaft 230 is selectively movable along vertical direction V between a down position (shown in FIGS. 4, 5, 6, 7, and 10) and an up position (shown in FIGS. 8, 9, 11, and 12). Shaft 230 has an upward end 232 and a downward end 234. For this embodiment, shaft 230 is formed from a rod, which may be constructed from metal, plastic, or other materials. Other constructions may be used as well. For example, shaft 230 may be a unitary member or may be constructed from multiple components connected or linked together.

With reference to FIGS. 4, 5, 6, 7, 10, and 11, the down position of shaft 230 locks agitator post 202 into receptacle 218 and helps ensure the transfer of torque to post 202. In the down position, downward end 234 of shaft 230 is received into a recess 228 (FIG. 10) defined by detent 236—which prevents rotation of agitator post 202 relative to impeller 204. Detent 236 may be formed by receptacle 218, impeller 204, or both. For this exemplary embodiment, downward end 234 includes at least one bend 258 (FIG. 5) and may include several to provide a hook shape or an L-shape that fits within recess 228. Other shapes or configurations may be used as well.

Figure 10:
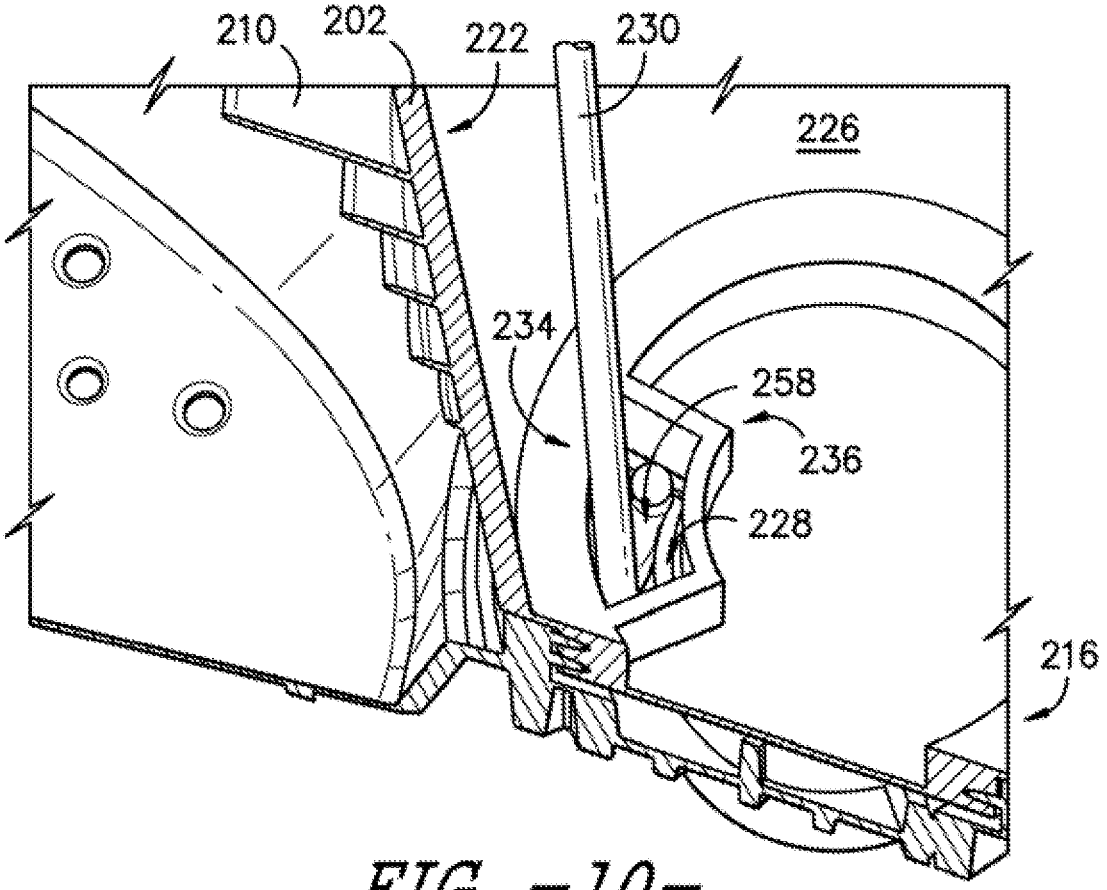
FIG. 10 is a partial cross-sectional view of the exemplary article movement mechanism of FIG. 3 in a down position. The view is near the bottom of an exemplary agitator post within an exemplary receptacle.

Upward end 232 of shaft 230 is connected with an actuator 238 that is configured for selectively moving shaft 230 between the up position and the down position. Upward end 232 includes at least one bend 260 forming a hook that is received into an opening 252 (FIG. 11) of actuator 238. Actuator 238 includes a button 240, a pair of opposing support arms 246, and a connecting arm 250 extending opposite from button 240 (FIG. 10). Connecting arm 250 extends orthogonally to an axis of rotation A-A defined by opposing support arms 246.

Figure 6:
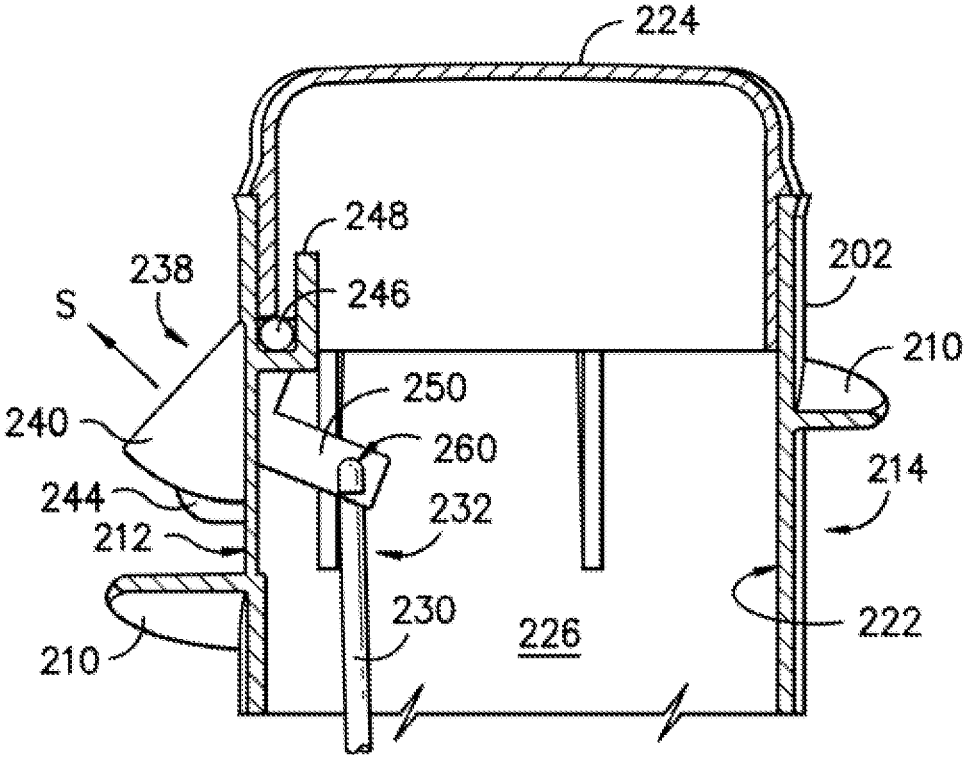
FIGS. 6 and 7 are cross-sectional side views of a portion of the exemplary article movement mechanism of FIG. 3 depicted a down position as further described herein.
Figure 7:
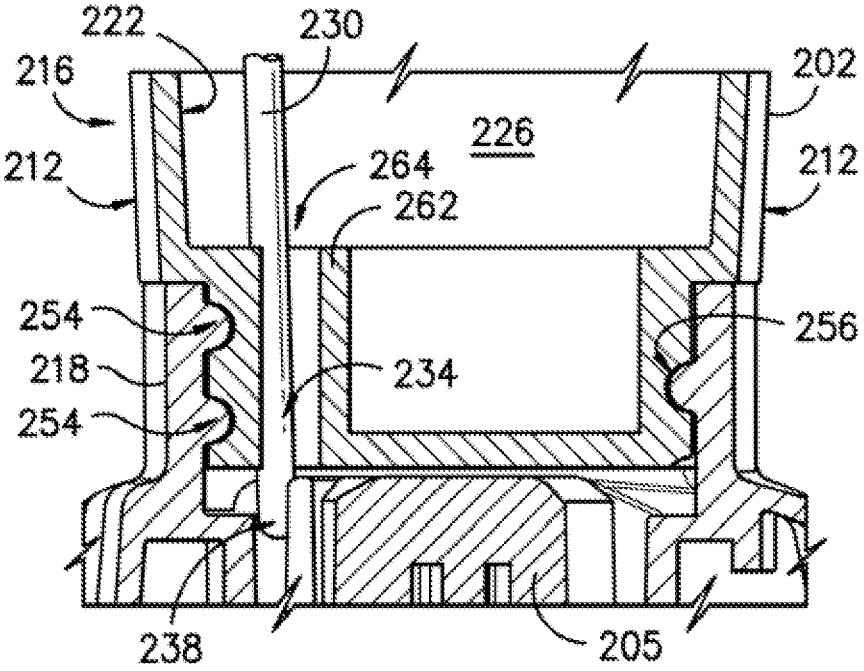
Figure 8:
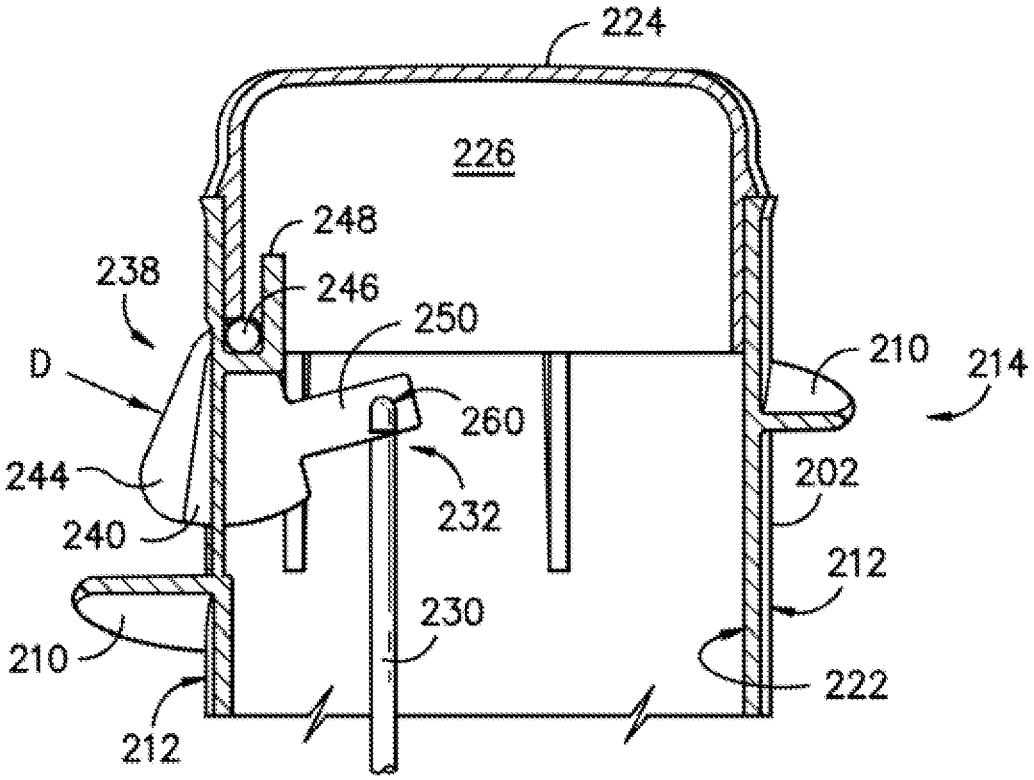
FIGS. 8 and 9 are cross-sectional side views of a portion of the exemplary article movement mechanism of FIG. 3 in an up position as further described herein.
Figure 9:
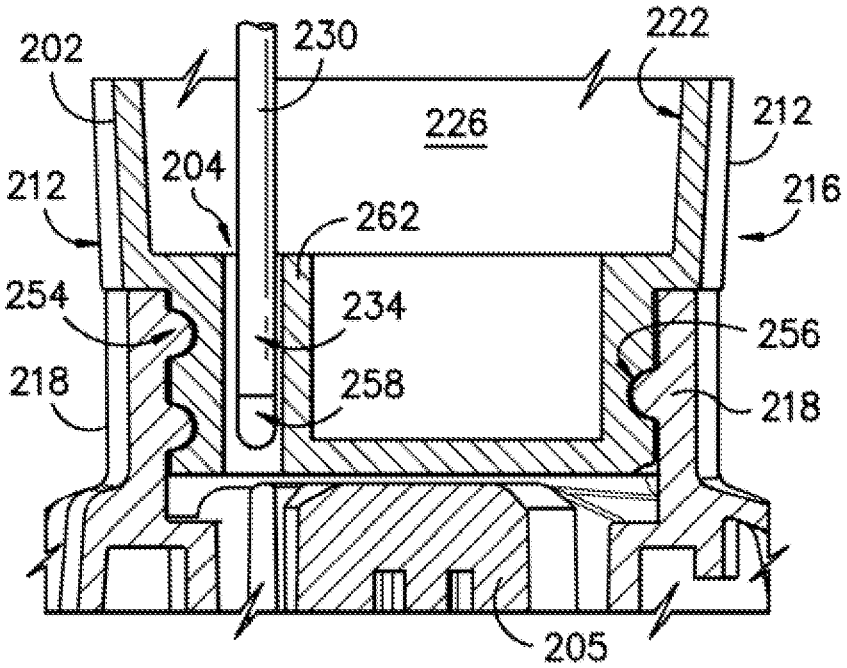
Figure 11:
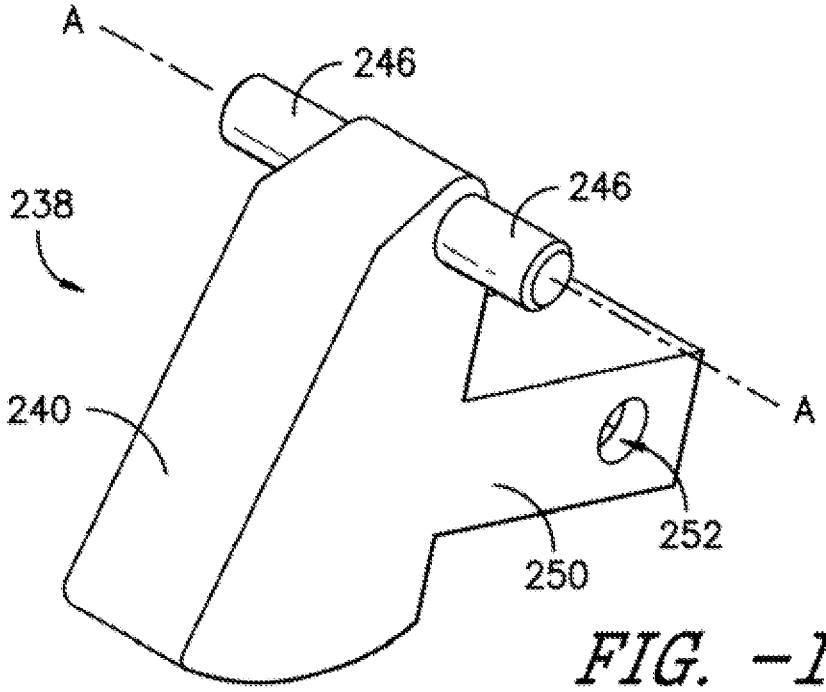
FIG. 11 is a perspective view of an exemplary actuator of the present invention.
Figure 12:
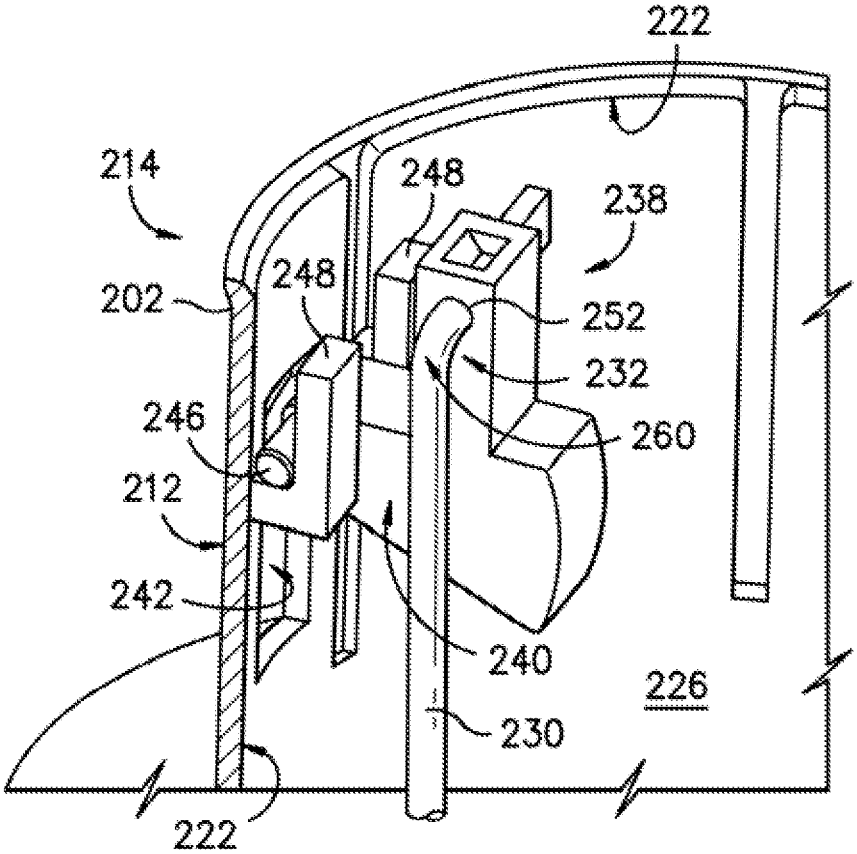
FIG. 12 is a partial cross-sectional view of a portion of the exemplary article movement mechanism of FIG. 3 depicting an up position. The view is near the top of an exemplary agitator post.
Figure 13:
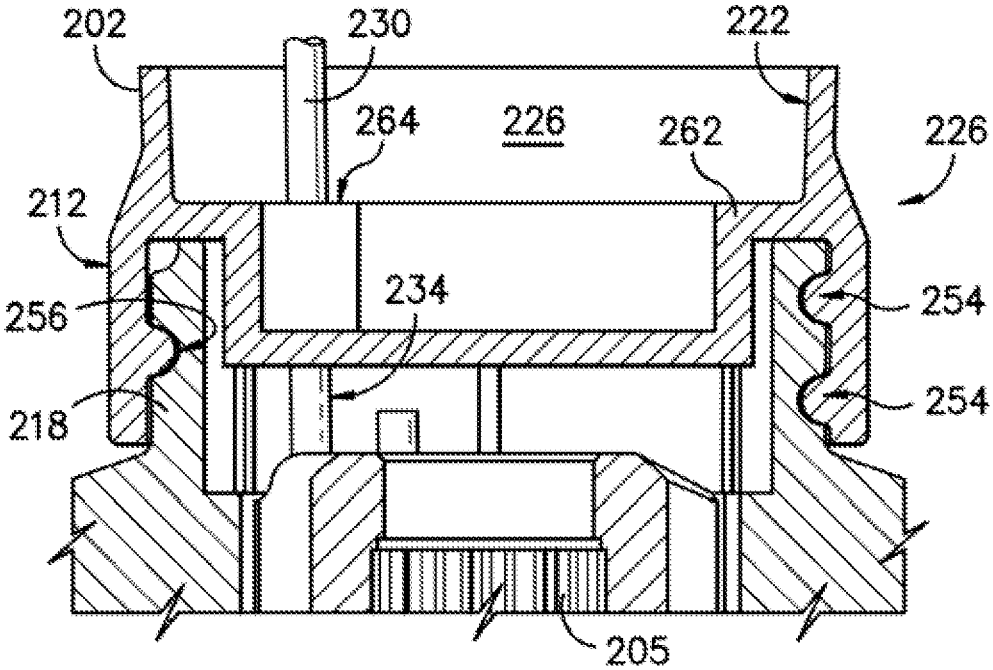
FIG. 13 is a partial cross-sectional view of the exemplary article movement mechanism of FIG. 3 depicting an up position. The view is near the bottom of an exemplary agitator post within an exemplary receptacle.

Actuator 238 is pivotally supported by agitator post 202. As shown in FIGS. 6, 8, and 11, opposing support arms 246 are received in hooks 248 extending from the interior surface 222 of agitator post 202. Support arms 246 have a pin-like or circular shape that allows their rotation within hooks 248 as a user presses upon button 240. Agitator post 202 defines an opening 242 at top end 214 through which the button 240 can move back and forth.

With reference to FIGS. 8, 9, 11, and 12, the up position of shaft 230 depicted therein provides that the downward end 234 is removed from recess 228 of detent 236. A user can selectively move shaft 230 between the down position and the up position by pressing button 240 as depicted by arrow D in FIG. 8. This causes actuator 238 to rotate or pivot on opposing support arms 246, which in turn raises extension arm 250 and shaft 230 to the up position. A user can then rotate agitator post 202 to disengage threads 254 and 256 and remove bottom end 216 from receptacle 218.

To install agitator post 202, the user depresses button 240, which raises shaft 230 to the up position as previously described. Bottom end 216 of agitator post 202 is placed within receptacle 218 and agitator post 202 is rotated unto position. Threads 254 and 256 are arranged so that rotation of agitator post 202 stops at a point where downward end 234 of shaft 230 is positioned over the recess 228 of detent 236. The user then release button 240, which allows gravity to pull shaft 230 into the down position and selectively lock agitator post 202 into position. In other embodiments of the invention, a spring may be used to also urge shaft 230 into the down position.

Support structure 262 in the bottom end 216 of agitator post 202 guides the movement of shaft 230. For example, an opening or channel 264 ensures that shaft 230 remains aligned vertically within the interior 226 of agitator post 202. Button shields 244 are positioned on each side of button 240. Button shields 244 help prevent articles from becoming entangled with button 240.

Accordingly, article movement mechanism 200 is equipped with an agitator post 202 (described with exemplary embodiments herein) that may be selectively removed or installed as desired by a user. Depending upon user preferences, the need for additional space for articles in wash chamber 120, or other factors, appliance 100 allows the user to decide when agitator post 202 will be utilized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing, the impeller supporting a receptacle;

an agitator post configured for removable positioning in the receptacle, the agitator post having a top end and a bottom end, the agitator post defining an interior;

a shaft positioned in the interior of the agitator post, the shaft movable along a vertical direction between an up position and a down position, the shaft having an upward end and a downward end;

a detent positioned at the receptacle, the detent configured for removable receipt of the downward end of the shaft when the bottom end of the agitator post is positioned in the receptacle; and an actuator positioned near the top end of the agitator post and in mechanical communication with the shaft, the actuator configured for selectively moving the shaft between the up position and the down position.

2. The washing appliance of claim 1, wherein the actuator is pivotally supported by the agitator post within an opening defined in the agitator post, wherein the actuator is movable in and out of the agitator post, and wherein the actuator is connected with the upward end of the shaft.

3. The washing appliance of claim 2, wherein the actuator further comprises a pair of opposing support arms received by the agitator post.

4. The washing appliance of claim 3, wherein the agitator post defines a pair of hooks for receipt of the opposing support arms.

5. The washing appliance of claim 3, wherein the actuator includes a connecting arm extending into the interior of the agitator post, the connecting arm defining an opening for receipt of the upward end of the shaft.

6. The washing appliance of claim 1, wherein the receptacle and the bottom end of the agitator post define complementary threads to releasably secure the agitator post by rotation within the receptacle.

7. The washing appliance of claim 6, wherein the downward end of the shaft is positioned at the detent after the agitator post is rotated into position within the receptacle.

8. The washing appliance of claim 1, wherein the shaft comprises a rod defining at least one bend at the downward end.

9. The washing appliance of claim 1, wherein the detent comprises a recess defined by the impeller.

10. The washing appliance of claim 1, wherein the agitator post further comprises a helical vane extending around an outer surface of the agitator post and the impeller comprises a plurality of lobes spaced-apart along a circumferential direction of the impeller.

11. A washing appliance, comprising:

a wash tub positioned in a wash chamber;

a wash drum rotatably mounted within the wash chamber and configured for receiving articles for washing;

an impeller positioned in the wash drum, the impeller being rotational about a vertical axis and configured for imparting motion to the articles during washing;

a receptacle supported by the impeller;

an agitator post having a top end and a bottom end, the bottom end configured for removable receipt in the receptacle;

a shaft carried by agitator post, the shaft movable between an up position and a down position, the shaft having an upward end and a downward end;

a detent positioned at the receptacle;

the detent positioned below the downward end of the shaft when the agitator post is positioned into the receptacle; and an actuator supported on the agitator post and connected with the shaft, the actuator configured for movement relative to the agitator post so as to selectively move the shaft between the up position and the down position.

12. The washing appliance of claim 11, wherein the actuator is pivotally supported by the agitator post, and wherein the actuator is movable in an out of an opening in the agitator post.

13. The washing appliance of claim 12, wherein the actuator further comprises a pair of opposing support arms received by the agitator post.

14. The washing appliance of claim 13, wherein the agitator post defines a pair of hooks for receipt of the opposing support arms.

15. The washing appliance of claim 13, wherein the actuator includes a connecting arm having an opening in receipt of the upward end of the shaft.

16. The washing appliance of claim 11, wherein the receptacle and the bottom end of the agitator post define complementary threads to releasably secure the agitator post by rotation within the receptacle.

17. The washing appliance of claim 16, wherein the downward end of the shaft is positioned over the detent after the agitator post is rotated into position within the receptacle.

18. The washing appliance of claim 11, wherein the shaft comprises a rod defining at least one bend at the downward end.

19. The washing appliance of claim 11, wherein the detent comprises a recess defined by the impeller.

20. The washing appliance of claim 11, wherein the agitator post further comprises a helical vane extending around an outer surface of the agitator post and the impeller comprises a plurality of lobes spaced-apart along a circumferential direction of the impeller.

* * * * *